US005797441A

United States Patent [19]

Benthin

[11] Patent Number: 5,797,441

[45] Date of Patent: Aug. 25, 1998

[54] DEVICE FOR MANUALLY OPERATING A BLIND

[75] Inventor: Siegfried Benthin, Bremerhaven, Germany

[73] Assignee: Benthin Aktiengesellschaft, Bremerhaven, Germany

[21] Appl. No.: 824,826

[22] Filed: Mar. 26, 1997

[30] Foreign Application Priority Data

May 28, 1994 [DE] Germany ..... 44 18 735.1

[51] Int. Cl.[6] ..... E06B 9/30

[52] U.S. Cl. ..... 160/173 V; 160/178.1 V; 160/900

[58] Field of Search ..... 160/178.1 R, 178.1 V, 160/178.2 R, 168.1 R, 168.1 V, 173 R, 173 V, 176.1 R, 176.1 V, 344, 319, 320, 321, 900, 331, 172 R, 172 V, 322

[56] References Cited

U.S. PATENT DOCUMENTS

| | | | |
|---|---|---|---|
| 2,557,978 | 6/1951 | Krumm | 160/172 R X |
| 3,478,807 | 11/1969 | Hertzberg | 160/344 |
| 3,633,646 | 1/1972 | Zilver | 160/178.2 R X |
| 4,865,108 | 9/1989 | Hennequin et al. | 160/172 R |
| 5,125,447 | 6/1992 | Suggs | 160/320 X |
| 5,465,775 | 11/1995 | Biba et al. . | |
| 5,465,779 | 11/1995 | Rozon . | |
| 5,472,035 | 12/1995 | Biba et al. . | |
| 5,595,232 | 1/1997 | Benthin | 160/320 X |
| 5,645,685 | 7/1997 | Furhman | 160/178.2 R X |

FOREIGN PATENT DOCUMENTS

| | | |
|---|---|---|
| 1 947 361 | 4/1970 | Germany . |
| 28 07 440 C2 | 6/1985 | Germany . |

*Primary Examiner*—David M. Purol
*Attorney, Agent, or Firm*—McGlew and Tuttle

[57] ABSTRACT

A device for the manual operation of a blind, preferably a vertical blind, by way of a pull cord, which is pulled as a loop with a leading end and a return end by a slat carriage movable in a guide with a slat each arranged on them around their longitudinal axis. The cord is led in a rail which blocks access to a majority of the cord. The rail has channels extending in a longitudinal direction defining passages for the leading end portion and the return end portion of the pull cord. The section rail also defines access openings for providing access by an operator to grip and move the pull cord through the rail. The rest of the rail blocks access to the pull cord.

12 Claims, 4 Drawing Sheets

VERTICAL BLIND SYSTEM

HORIZONTAL BLIND SYSTEM

DEVICE FOR MANUALLY OPERATING A BLIND

FIELD OF THE INVENTION

The present invention pertains to a device for operating a blind by means of a pull cord. The cord being formed in a loop with a leading side and a return side. The cord is led in a profiled rail which blocks access to a majority of the cord.

BACKGROUND OF THE INVENTION

Similar devices have been known from U.S. Pat. No. 5,595,232 which is incorporated by reference.

In vertical blinds, the guide for the traveling movement consists of a usually horizontally fastened support rail, so that the ends of the pull cord, which also extends horizontally in the support rail in the area to be covered by the blind, run over a deflecting means and hang down loosely, and the pull cord frequently also forms a loop in this part and is thus designed as an endless pull cord. The hanging-down loop of the pull cord is frequently disturbing and represents a hazard, especially for small children. The blind can be opened and closed manually by means of a device of the class described in the introduction, while the slat carriages are either pushed together at a storage place or they are pulled apart, spread over the area to be covered by the blind. Large blinds and special designs have motor drives, preferably electric motor drives, for the pull cord. Horizontal blinds, in which the slats are fastened directly to two or more pull cords, which are arranged in parallel to and at spaced locations from one another, are also designed correspondingly.

SUMMARY OF THE INVENTION

The primary object of the present invention is to avoid hazards especially for small children due to the pull cord and to improve the appearance of the hanging-down pull cord.

Another object of the present invention is to facilitate the manual operation of the blind and to make it more comfortable. Not only shall the appearance of the hanging-down pull cord be improved, but the safety of the device shall also be increased with respect to the possible accident hazard, especially for small children, compared with a pull cord hanging down loosely which creates a risk of strangulation. A simplified and consequently less expensive design shall be provided compared with the prior art.

According to the invention, a device for the manual operation of a blind is provided, preferably vertical blinds but also horizontal blinds. A pull cord is provided which is disposed in the manner of a loop and includes a leading end portion or side and a return end portion or side. A profiled section rail is provided accommodating the pull cord leading end portion and the return end portion. The sectional rail has channels extending in a longitudinal direction defining passages for the leading end portion and the return end portion of the pull cord. The section rail also defines access openings for providing access by an operator to grip and move the pull cord through the rail. The rest of the rail blocks access to the pull cord.

The sectional rail has channels extending in its longitudinal direction, through which the two ends of the pull cord, namely, the leading end and the return end, are led. These channels of the sectional rails, which may be open on the longitudinal sides, thus accommodate the ends of the pull cords in them. This pull cord thus no longer represents a hazard of strangling for small children. A preferred embodiment of the sectional rail has an H-shaped cross-sectional profile with convex lateral surfaces. A deflecting means for a pull cord guided as an endless pull cord may be provided at the lower end of the sectional rail. However, a pull cord of finite length is also possible, so that the leading end and the return end move up and down in the corresponding channel of the sectional rail during the operation of the blind.

The present invention is based on the discovery that a more reliable protection against strangulation is guaranteed even by the profiled rail. The aesthetic appearance is also improved due to the pull cord being movably guided in a profiled rail. Compared with the prior art, especially U.S. Pat. No. 5,595,232, the present invention offers the advantage that a separate grip element is completely abandoned. The present invention is considerably less expensive due to the elimination of this additional component. The pull cord can be easily grasped by hand due to the recessed grips and it can be slightly pulled out of the profiled rail. The operation is then performed by pulling the leading or trailing end by hand. Due to the tension of the pull cord, it is guaranteed that the pull cord can be pulled out of the profiled rail only to the extent that not even small children can put their heads between the pull cord and the profiled rail, so that the accident hazard is considerably reduced.

The rail can also have covers for covering the grooves holding the pull cord and preventing the cord from being excessively pulled out from the grooves. This offers the advantage that the pull cord or its leading and trailing ends are completely accommodated by the covers over a large area of its length. The pull cord can be pulled out of the profiled rail in a short area only. This area is advantageously selected to be such that the pull cord can be operated comfortably, on the one hand, but, on the other hand, the pull cord can be pulled out of the profiled rail to a very small extent only. The safety of the device is further improved as a result.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENT

Figure 5:
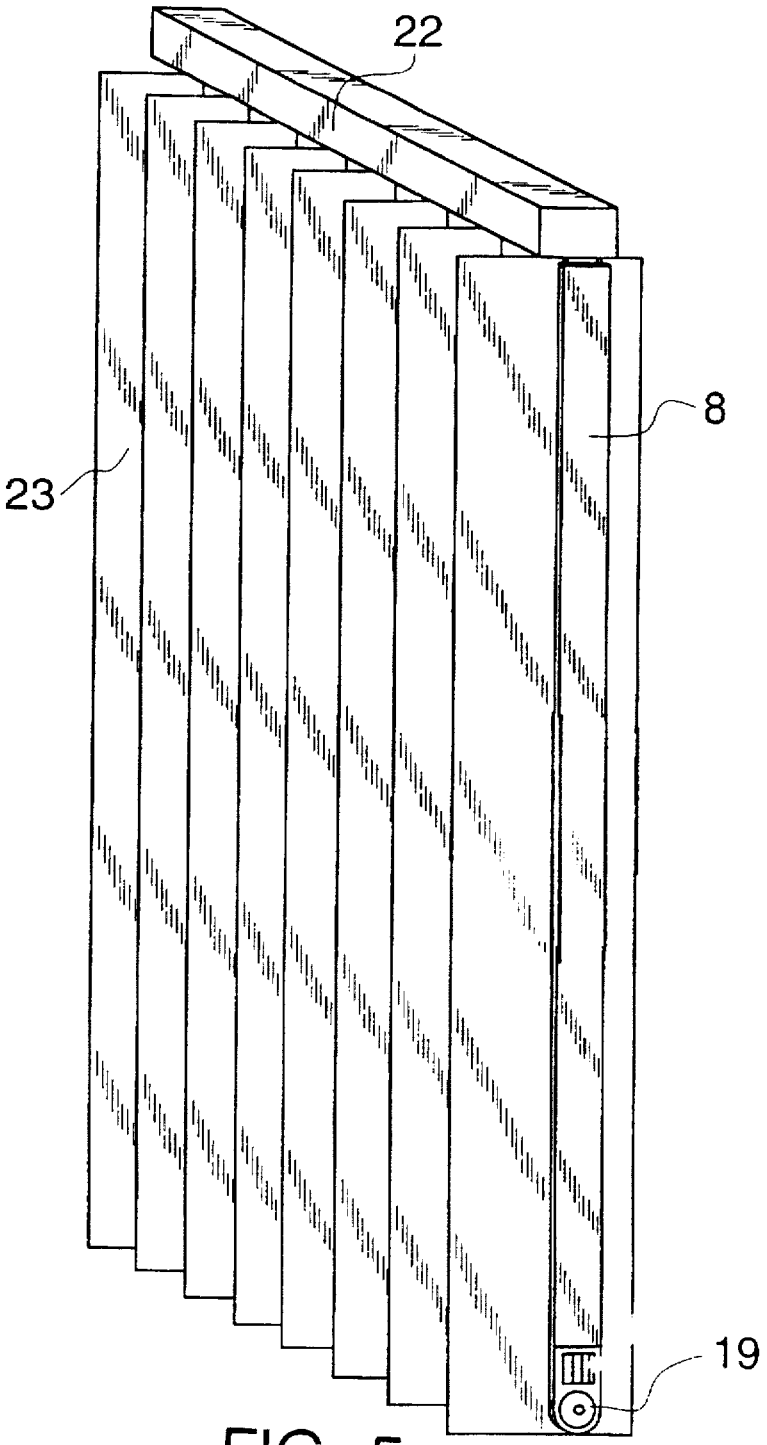
FIG. 5 shows a vertical blind system.
Figure 6:
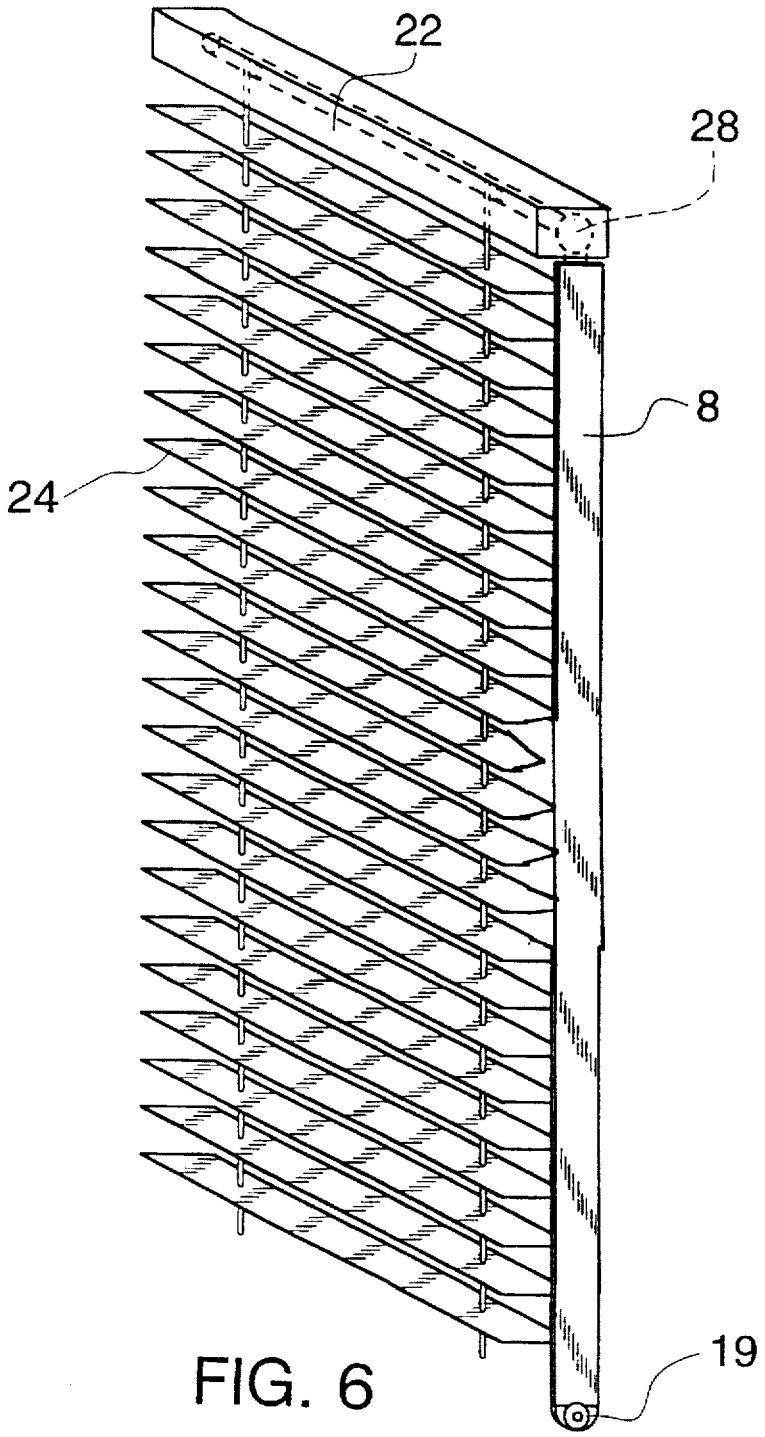
FIG. 6 shows a horizontal blind system.

The device according to the present invention is used to operate slats 23, 24, FIGS. 5 and 6, hanging on a carrier rail 22. The slats may be horizontal 24 or vertical slats 23. The slats are pulled up and down by means of a pull cord 6, while a crank rod 30 is used to tilt the slats around their longitudinal axis. The crank rod 30 is not the subject of the present invention and therefore it is not being described in greater detail.

Figure 4:
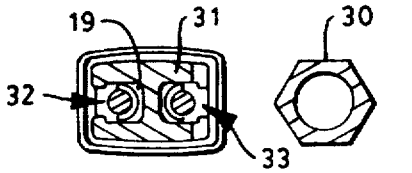
FIG. 4 shows a horizontal section in plane IV—IV according to FIG. 3.
Figure 7:
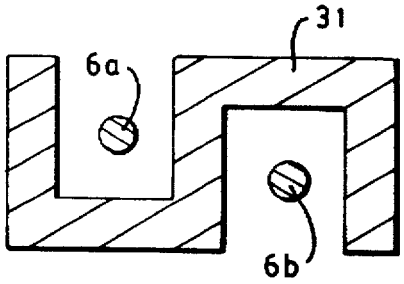
FIG. 7 shows a cross section with an S-shaped rail.

The pull cord 6 has a leading side 6a and a trailing side 6b. The pull cord 6 is movably guided in a vertically extending and stationarily arranged profiled rail 31. The profiled rail has an H-shaped cross section in this case, which can be recognized especially clearly in FIG. 4. The rail 31 can also have an S-shape as shown in FIG. 7. Two open channels 32 and 33 are formed due to the H-shaped cross section of the profiled rail 31. The pull cord 6 is thus enclosed on three sides.

The pull cord 6 is deflected at its lower end by a deflecting roller 19, which is rotatably mounted at the lower end of the profiled rail by means of a shaft 34. Alternatively the deflecting roller can be also any other suitable guide or deflecting structure.

To make it possible to grasp the pull cord or its leading and trailing ends, the profiled rail 31 has two access openings acting as recessed grips 35 and 36. In this case, the leading end or side 6a can be grasped by the recessed grip 35, and the trailing end or side 6b can be grasped by the recessed grip 36. The recessed grips are arranged vertically offset in relation to one another. An excessive reduction in the cross section of the profiled rail due to the recessed grips 35, 36 is avoided as a result.

Figure 1:
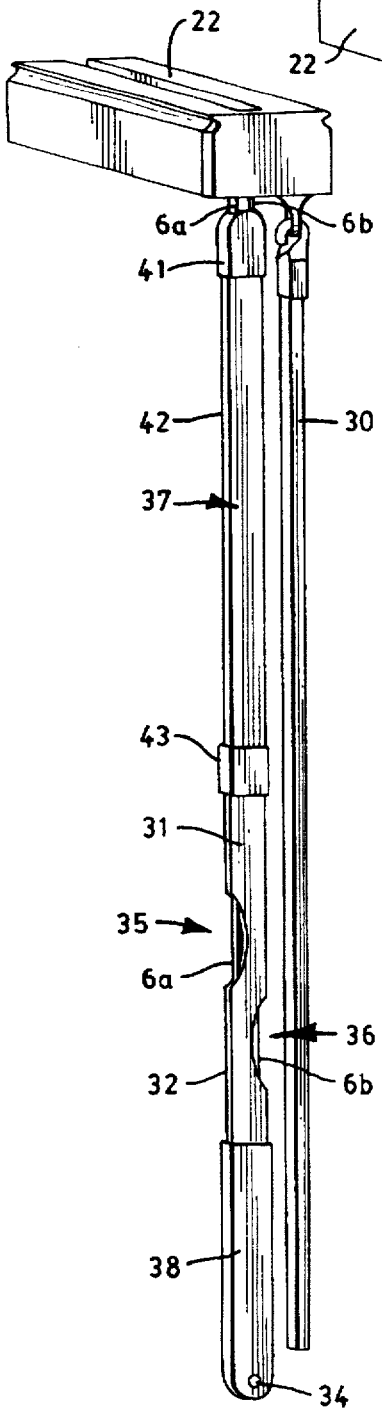
FIG. 1 shows a perspective view of the device according to the present invention.
Figure 2:
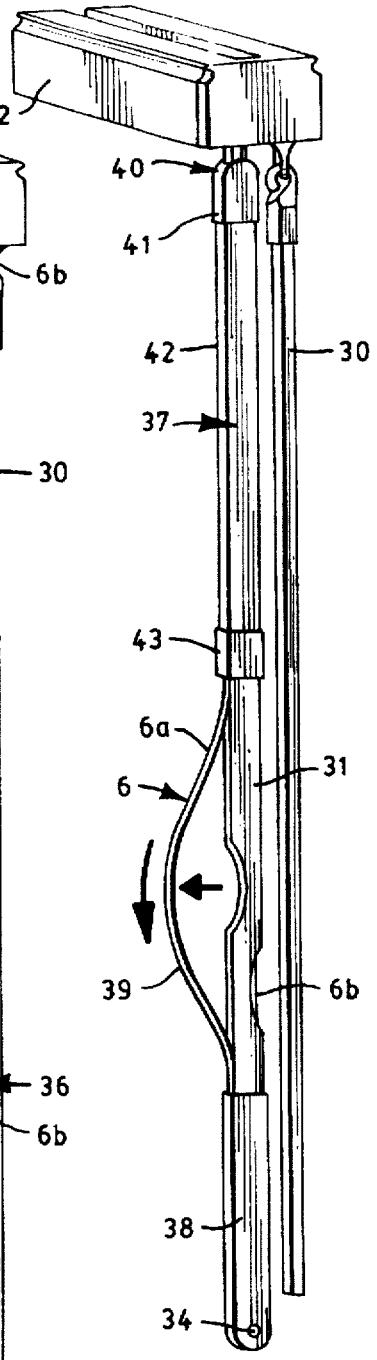
FIG. 2 shows the device according to FIG. 1 with the leading or trailing end of a pull cord pulled out.
Figure 3:
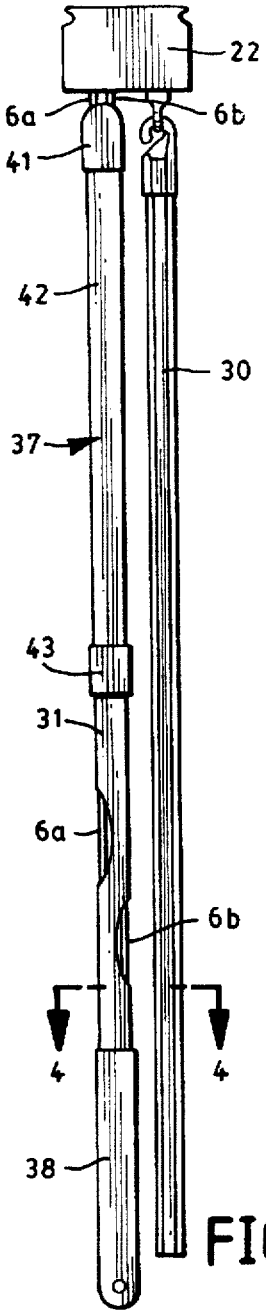
FIG. 3 shows a side view of the device.

At its upper end and at its lower end, the profiled rail 31 also has a cover 37 and 38 each. The covers 37, 38 have a beaker-shaped design and are pulled over the top and lower ends of the profiled rail 31, respectively. The upper cover 37 comprises in this case a tube 42 with an upper cover sleeve 41 and a lower cover sleeve 43. This design offers the advantage that the upper cover can always be adjusted to the actual length of the profiled rail 31, because the tube 42 is cut off corresponding to the length of the profiled rail 31. The upper and lower cover sleeves 41, 43 are used to cover cut edges on the tube 42. The upper cover sleeve 41 has on its front side an opening 40, through which the pull cord 6 is led into the interior of the cover 37. The pull cord 6 is completely enclosed by the covers 37 and 38. As is shown in FIG. 2, the pull cord can be pulled out of the respective channels 32 and 33 of the profiled rail 31 in the area between the covers 37, 38 only. As a result, there is only a very small free loop 39, by which the pull cord 6 can be grasped by hand and be operated by pulling in the downward direction. Due to the geometric conditions and the tension in the pull cord 6, the loop 39 is just large enough for comfortable access to the pull cord 6 to be guaranteed. On the other hand, the loop 39 is small enough so that not even small children can put their heads into the loop 39. As a result, the strangulation of small children by the pull cord 6 is ruled out. Thus, an accident hazard is reliably avoided with very simple means. In addition, the pull cord 6 can be operated directly by hand, as usual. There is no need to getting used to, or learning, the gripping elements of the prior art.

While specific embodiments of the invention have been shown and described in detail to illustrate the application of the principles of the invention, it will be understood that the invention may be embodied otherwise without departing from such principles.

What is claimed is:

1. A device for operation of a blind, the device comprising:

a pull cord including a leading end portion and a return end portion;

a rail accommodating said pull cord, said pull cord being movably positioned in, and guided by, said rail defining an access opening for providing access by an operator for griping and moving said pull cord through said rail, said rail blocking access to said pull cord in areas other than said access opening, said rail includes a first cover between a first end of said rail and said access opening, said rail includes a second cover between a second end of said rail and said access opening.

2. A device in accordance with claim 1, wherein:

said rail encloses three sides of said pull cord in areas other than said access opening.

3. A device in accordance with claim 2, wherein:

said rail has one of an S and H shaped design.

4. A device in accordance with claim 1, wherein:

said rail defines a groove for receiving said pull cord.

5. A device in accordance with claim 1, wherein:

said access opening exposes three sides of said pull cord.

6. A device in accordance with claim 1, wherein:

said rail defines another access opening, said access opening provides access to said leading end portion, said another access opening provides access to said return end portion.

7. A device in accordance with claim 1, wherein:

said rail blocks access to all portions of said pull cord except for said access opening.

8. A device in accordance with claim 1, wherein:

said leading end portion and said return end portion form a loop.

9. A device in accordance with claim 1, further comprising:

a deflecting roller disposed at a lower end of said rail, said deflecting roller guiding said pull cord in the form of an endless loop.

10. A device in accordance with claim 1, wherein;

said rail is provided with a longitudinal axis arranged vertically aligned in parallel to said leading end portion and said return end portion of said pull cord.

11. A device in accordance with claim 1, wherein:

said access opening is spaced from said first and second ends of said rail.

12. A device for operation of a blind, the device comprising:

a pull cord including a leading end portion and a return end portion;

a rail accommodating said pull cord, said pull cord being movably positioned in, and guided by, said rail defining an access opening for providing access by an operator for griping and moving said pull cord through said rail, said rail blocking access to said pull cord in areas other than said access opening, said rail defining a groove for receiving said pull cord, said rail including a first cover between a first end of said rail and said access opening, said rail including a second cover between a second end of said rail and said access opening, said covers cover said groove and block access to said groove and said pull cord.

* * * * *